United States Patent [19]

Krippes

[11] 4,266,988

[45] May 12, 1981

[54] COMPOSITION AND PROCESS FOR INHIBITING CORROSION OF FERROUS OR NON-FERROUS METAL SURFACED ARTICLES AND PROVIDING RECEPTIVE SURFACE FOR SYNTHETIC RESIN COATING COMPOSITIONS

[75] Inventor: William D. Krippes, Schaumburg, Ill.

[73] Assignee: J. M. Eltzroth & Associates, Inc., Schaumburg, Ill.

[21] Appl. No.: 133,955

[22] Filed: Mar. 25, 1980

[51] Int. Cl.[3] ..... C23F 7/26

[52] U.S. Cl. ..... 148/6.21; 148/6.2

[58] Field of Search ..... 148/6.2, 6.21

[56] References Cited

U.S. PATENT DOCUMENTS

| | | | |
|---|---|---|---|
| 2,948,643 | 8/1960 | Pimbley | 148/6.2 |
| 3,130,086 | 4/1964 | Otto | 148/6.21 |
| 3,404,046 | 10/1968 | Russell et al. | 148/6.2 |
| 3,895,969 | 7/1975 | Miller | 148/6.21 |

*Primary Examiner*—Ralph S. Kendall

*Attorney, Agent, or Firm*—Richard L. Johnston

[57] ABSTRACT

No-rinse compositions and a process are provided for inhibiting corrosion of ferrous or non-ferrous metal surfaces and for producing a surface to which synthetic resin coating compositions will adhere so that the resultant coatings have satisfactory impact and bending resistance, together with resistance to creeping corrosion between the metal and the dried resin coating.

23 Claims, No Drawings

COMPOSITION AND PROCESS FOR INHIBITING CORROSION OF FERROUS OR NON-FERROUS METAL SURFACED ARTICLES AND PROVIDING RECEPTIVE SURFACE FOR SYNTHETIC RESIN COATING COMPOSITIONS

BACKGROUND

Ferrous and non-ferrous metal surfaced articles, for example, cold rolled steel, aluminized and galvanized iron and steel, aluminum, aluminum-zinc alloy, magnesium, magnesium-aluminum alloys may suffer surface deterioration by corrosion through contact with the atmosphere or moisture, or both. Chemical passivation treatments are widely used to inhibit or suppress such surface corrosion.

One of the passivating treatments employed for this purpose consists in treating the ferrous or non-ferrous metal surface with an aqueous solution of phosphoric acid or its salt and a solution of chromic acid, respectively.

While phosphate and chromic acid based passivating solutions have been widely adopted they have been by no means effective in preventing corrosion under all conditions, particularly in high speed operations and especially where the treated surface is further coated with a synthetic resin coating composition which dries to form a synthetic resinous film. The manner in which the ferrous and/or non-ferrous metal surface is pretreated may make the difference between satisfactory adherence of the resinous film to the substrate and non-adherence as well as satisfactory resistance of the coating or film to impact, bending, boiling water, and creeping corrosion between the surface of the metal and the resinous film.

It would be desirable, therefore, to provide a process in which corrosion of the ferrous or non-ferrous metal surface is inhibited and wherein the ferrous or non-ferrous metal surface is receptive to a synthetic resinous coating composition so that the resultant coating products containing a dried film of the resin have satisfactory impact and bending qualities as well as resistance to creeping corrosion beneath the coating of synthetic resin.

It would also be desirable to provide a process in which ferrous or non-ferrous metal surfaces can be treated at high linear speeds of say 50–1000 feet per minute or even higher so as to produce a treated article which is corrosion resistant and has a surface which will adhere to synthetic resin coating compositions.

It would also be desirable to be able to produce such coating with little or no pollution.

OBJECTS

One of the objects of the present invention is to provide a new and improved process for preparing said ferrous or non-ferrous metal surfaced articles with surfaces inhibited against corrosion and adapted to adhere to synthetic resin coating compositions, thereby producing articles coated with a synthetic resinous film having satisfactory impact and bending resistance and resistance to creeping corrosion between the metal and the resinous coating.

Another object of the invention is to provide a process of the type described in which a ferrous or non-ferrous metal surfaced article is brought into contact at a high rate of speed, for example, at a linear speed of at least 50 feet per minute, with an aqueous solution of a composition which will inhibit corrosion on the surface of said article and at the same time enhance the receptivity of said surface for synthetic resin coating compositions.

A further object is to provide a no-rinse treating bath that when properly applied will not generate spent bath containing either phosphate or chromate that must be disposed of and which by avoiding rinsing overcomes disposal problems with respect to contaminant containing environmentally undesirable rinse waters.

A further object of the invention is to produce new and useful compositions for treating ferrous or non-ferrous metal surfaces which are effective for the purposes previously indicated.

Other objects will appear hereinafter.

BRIEF SUMMARY OF THE INVENTION

In accordance with the invention a ferrous or non-ferrous metal surfaced article is treated with an aqueous chromate depositing solution containing hexavalent chromium but no trivalent chromium, together with fluoboric acid, hydrofluoric acid, sulfuric acid, with or without hydrofluosilicic acid, said solution also containing as an additive zinc oxide and/or magnesium oxide, and/or magnesium hydroxide, and/or aluminum sulfate, and/or aluminum hydroxide, the ratio of said additive to the total acids being such as to give a pH within the range of 1.5 to 3.6 at 22° C. and a chromate concentration of 0.05 to 10.0 grams per liter, as Cr. Compositions of the type described when employed in treating clean ferrous or non-ferrous metal surfaced articles provide enhanced adherency of the treated surface to organic film-forming polymers which dry to a water resistant coating and do not require rinsing of the treated surface prior to the application of the organic film-forming polymers, thereby avoiding environmental contamination that would otherwise be caused by rinse waters.

DETAILED DESCRIPTION OF THE INVENTION

The composition of the chromate depositing solution should be such that it will be effective in inhibiting corrosion and in enhancing adherence of a surface coating when a ferrous or non-ferrous metal surfaced article is brought into contact with the chromate depositing solution for one to three seconds, which may represent a linear speed of a metal sheet to be treated of 50 to 1000 feet per minute at a pH of 1.5 to 3.6 at 22° C. A chromate concentration of 0.05–10.0 grams per liter, as Cr, will give approximately, depending upon the equipment used, a total coating of 3 milligrams per square foot to 80 milligrams per square foot. The coating weight will depend upon the metal used and the end use. The pH is an important factor depending upon the particular metal. Thus, in treating aluminum and galvanized iron, as the pH goes down from 3.5 to 1.8 the coating weight increases with the same Cr concentration. Just the opposite effect occurs in the treatment of cold rolled steel. After the surface has been coated with the previously described chromate depositing solution it can be coated or painted without rinsing with a composition comprising an organic film-forming polymer which dries to a water resistant coating.

The organic film-forming polymer can be any of the well known types of coating resins used, either as primer coats or as finish coats, including either water dispersed or oil dispersed resins. While acrylic resin coating compositions are especially useful, other organic film-forming polymers can be employed, for example, polyvinyl chloride, epoxy resins, mixed epoxy-acrylic resins, polyester resins and polyurethane resins. In most cases these resins are applied and baked on the coated metal but it appears that some further reaction takes place on the surface of the ferrous or non-ferrous metal after the resinous film has been applied and during the baking period. A particular advantage of the invention resides in the fact that the coating composition contains no sodium salts or other highly soluble salts which would tend to take up moisture after the coating has dried or even after the coated article has dried.

The coating composition is normally prepared as a concentrate which is then diluted with water to the desired concentration for coating a particular type of metal, the concentration also depending upon the amount of the coating to be deposited upon the metal.

In carrying out the process of the invention the temperature of the chromate depositing solution for use on ferrous or non-ferrous metal surfaced articles is normally within the range of 70° F. to 210° F. and usually 120° F. to 140° F.

The time of contact between the chromate depositing solution and the ferrous or non-ferrous metal surfaced article will normally be within the range of one second to 3 seconds. In the latter case the pH of the solution can also be somewhat higher, but would be within the range of 0.8 to 5.0.

The chromate depositing solution can have a solids content within the range from 0.2 gram per liter to 75.0 grams per liter, the remainder being water, and the chemical composition should be essentially the following:

TABLE I

| Ingredients | Grams per Liter |
|---|---|
| Chromic acid ($CrO_3$), (expressed as Cr) | 0.10–50.0 |
| Hydrofluoric acid ($H_2F_2$) (expressed as F) | 0.01–5.0 |
| Fluoboric acid ($HBF_4$) (expressed as $BF_4$) | 0.01–50.0 |
| Sulfuric acid ($H_2SO_4$) (expressed as $SO_4$) | 0.01–5.0 |
| Hydrofluosilicic acid ($H_2SiF_6$) (expressed as $SiF_6$) | 0.0–5.0 |
| Additive from the group consisting of: zinc oxide, magnesium oxide, magnesium hydroxide, aluminum sulfate, aluminum hydroxide and mixtures thereof | 0.01–saturation solubility at 22° C. |

Especially good results are obtained by using zinc oxide as the additive in proportions of 1 to 6 grams per liter. It will be understood, of course, that zinc oxide can combine with chromic acid to form zinc chromate ($ZnCrO_4$). Normally, however, it is preferable for the quantity of chromic acid to exceed the quantity of zinc oxide which would combine with the chromic acid to form zinc chromate. Thus, in a preferred concentrate formula the weight ratio of $CrO_3$ to ZnO is approximately 1.8:1 or a molar ratio of $CrO_3$ to ZnO of 1.4:1 whereas the molar ratio of $CrO_3$ to ZnO in zinc chromate is 1:1. As indicated, the hydrofluosilicic acid can be omitted from the formula. It is not required in coating aluminum and only a small amount is desired in coating cold rolled steel. The ratio of the additive (e.g., zinc oxide) to total acids in the coating bath is preferably such as to give a pH within the range of 1.8 to 3.5 at predetermined concentrations used in the coating process.

The invention will be further illustrated but is not limited by the following examples in which the proportions are in weight unless otherwise indicated.

EXAMPLE I

A concentrate was prepared by mixing together the following ingredients:

| Ingredients | Percent |
|---|---|
| $CrO_3$ | 12.0 |
| ZnO (French processed) | 0.8 |
| $H_2F_2$ (48% concentration) | 2.6 |
| $H_2SiF_6$ (26% concentration) | 0.4 |
| $HBF_4$ (48% concentration) | 0.8 |
| $H_2SO_4$ (78–80% concentration) | 0.8 |
| $H_2O$ | 82.6 |

This concentrate has a specific gravity of approximately 1.11.

Water is added to the foregoing concentrate in sufficient amount to give a running bath having a concentration of 0.5–1% with a pH of approximately 1.8.

The metal to be processed or coated can be, for example, cold rolled steel, aluminized and galvanized iron and steel, aluminum, aluminum-zinc alloys, magnesium or magnesium-aluminum alloys. Typical examples of cold rolled steel are SAE 1005 or 1010.

The concentration of 0.5–1.0% is given as Cr. The weight ratio of the amount of water added to the concentrate is approximately 15:1. This ratio may vary depending upon the desired concentration of the depositing solution but will usually be within the range of 3:1 to 50:1.

The metal to be coated is carefully cleaned with an alkaline cleaner at 160° F., hot water rinsed at 140°–180° F. and then coated in a coating bath containing a predetermined concentration of the foregoing composition and having a predetermined pH which is adjusted by adding more or less of the zinc oxide or other additive previously described to the concentrates. The coating weight on the metal will depend upon the particular metal and the pH of the coating bath. Thus, on aluminum, lowering the pH from 2.7 to 1.8 increases the coating weight with a given concentration of chromate, as Cr, from 7 to 14.4 mg/square foot, as Cr. Likewise on galvanized iron lowering the pH from 2.7 to 1.8 increases the coating weight from 2.8 to 12 mg/square foot, as Cr. An optimum pH is 1.8 to 2.0.

On cold rolled steel lowering the pH reduces the coating weight. Thus, at a pH of 3 the coating weight is approximately 34.5 mg/square foot, as Cr, and at a pH of 2 the coating weight is approximately 20.0 mg/square foot, as Cr. As the Cr concentration is increased from 0.05 to 10.0 grams per liter, with constant pH, the total coating weight may increase from 3 mg/square foot to 80 mg/square foot.

The foregoing coating weights are based on an application of 3 seconds contact time using a roll coater, dip, spray or other type of coating, followed by a squeegee to remove excess coating composition. Removal of excess composition is quite important. The application of the coating composition to the metal is preferably with a time period range of 1 second to 10 seconds. After coating, most of the excess is removed by passing the metal in strip form through a squeegee and it is desirable to dehydrate the coated metal as much as possible before painting. Paints are preferably baked on the metal at temperatures up to 550° F. Any kind of synthetic resin coating composition can be applied which dries to a water resistant film.

Both corrosion resistance and adherence are enhanced.

Aluminum coated with a coating composition of the type described above is coated with a polyvinyl chloride primer and top coat baked on in the manner described above will withstand standard salt spray tests for at least 2000–3000 hours. Galvanized steel similarly coated will withstand standard salt spray tests at least 900–1000 hours. Cold rolled steel similarly coated will withstand standard salt spray tests at least 600 hours.

EXAMPLE II

The following example illustrates other compositions in the form of concentrates which can be prepared in accordance with the invention and diluted with water to coating baths having various concentrations depending upon the metal to be coated and the desired coating weight.

| Ingredients | Grams Per Liter |
|---|---|
| $ZnCrO_4$ | 4 |
| $HBF_4$ (48%) | 1 |
| $H_2F_2$ (48%) | 1 |
| $H_2SO_4$ (78%) | 1 |
| Remainder water | |

When diluted with water to a concentration of 30% the pH at 22° C. is approximately 3.0.

EXAMPLE III

| Ingredients | Grams per Liter |
|---|---|
| $CrO_3$ | 2.5 |
| $H_2SO_4$ (78%) | 0.75 |
| ZnO | 0.25 |
| $H_2F_2$ (48%) | 0.5 |
| $HBF_4$ (48%) | 0.5 |
| Remainder $H_2O$ | |

When diluted with water to a concentration of 25% the pH at 22° C. is approximately 2.2.

EXAMPLE IV

| Ingredients | Grams per Liter |
|---|---|
| $CrO_3$ | 10 |
| ZnO | 1 |
| $H_2SO_4$ (78%) | 1 |
| $H_2F_2$ (48%) | 1 |
| $HBF_4$ (48%) | 1 |
| $H_2SiF_6$ (26%) | 1 |
| Remainder $H_2O$ | |

When diluted with water to a concentration of 10% the pH at 22° C. is approximately 2.2.

EXAMPLE V

| Ingredients | Grams per Liter |
|---|---|
| $CrO_3$ | 90 |
| ZnO | 6 |
| $H_2SO_4$ (78%) | 6 |

-continued

| Ingredients | Grams per Liter |
|---|---|
| $HBF_4$ (48%) | 6 |
| $H_2SiF_6$ (26%) | 3 |
| Remainder $H_2O$ | |

When diluted with water to a concentration of 2% the pH at 22° C. is approximately 1.9.

EXAMPLE VI

| Ingredients | Grams per Liter |
|---|---|
| $CrO_3$ | 90 |
| ZnO | 8 |
| $H_2SO_4$ (78%) | 6 |
| $HBF_4$ (48%) | 6 |
| Remainder $H_2O$ | |

When diluted with water to a concentration of 2% the pH at 22° C. is approximately 2.0.

EXAMPLE VII

| Ingredients | Grams per Liter |
|---|---|
| $CrO_3$ | 90 |
| MgO | 6 |
| $HBF_4$ (48%) | 6 |
| $H_2F_2$ (48%) | 6 |
| Remainder $H_2O$ | |

When diluted with water to a concentration of 2% the pH at 22° C. is approximately 2.2.

EXAMPLE VIII

| Ingredients | Grams per Liter |
|---|---|
| $CrO_3$ | 90 |
| $Mg(OH)_2$ | 6 |
| $HBF_4$ (78%) | 6 |
| $H_2F_2$ (48%) | 6 |
| Remainder $H_2O$ | |

When diluted with water to a concentration of 2% the pH at 22° C. is approximately 1.9.

EXAMPLE IX

| Ingredients | Grams per Liter |
|---|---|
| $CrO_3$ | 90 |
| $Al_2(SO_4)_3$ | 9 |
| $HBF_4$ (48%) | 6 |
| $H_2F_2$ (48%) | 6 |
| Remainder $H_2O$ | |

When diluted with water to a concentration of 2% the pH at 22° C. is approximately 1.9.

In the foregoing Examples I to IX the concentration percentages, after dilution with water, refer to percentages of the original concentrate. Thus, the addition of 3000 parts by weight of water to 1000 parts by weight of the concentrate would be a dilution with water to a concentration of 25% of the original concentrate. In general, as previously indicated, the amount of water added would be within the range of 3 to 50 times the weight of the concentrate.

EXAMPLE X

| Ingredients | Grams per Liter |
|---|---|
| $CrO_3$ | 113.2 |
| ZnO | 63.5 |
| $H_2F_2$ (48%) | 24.5 |
| $HBF_4$ (48%) | 7.5 |
| $H_2SO_4$ (78%) | 7.5 |
| $H_2SiF_6$ (26%) | 3.8 |
| Remainder $H_2O$ | |

When the foregoing concentrate is diluted the pH at 22° C. varies from about 3.1 at a concentration of chromate depositing solution of 0.2% to a pH of 2.9 at a concentration of 10% to a pH of 2.4 at a concentration of 20% to a pH of approximately 2.3 at a concentration of 30%.

When the zinc oxide concentration in the concentrate is varied from zero to the saturation level the pH of a 1% solution of the concentration varies from approximately 1.9 to 4.0 at 22° C. using pH paper to measure the pH.

The amount of zinc oxide that will go into solution also varies with the percent concentration by weight of $CrO_3$ in the concentrate and increases within increasing concentrations of $CrO_3$, the preferred weight ratio of $CrO_3$ to ZnO being that given in Example X which is approximately 2:1.

The best modes contemplated for the practice of the invention are illustrated by Examples I and X. Example VII illustrates the practice of the invention where magnesium oxide is used rather than zinc oxide. Example VIII illustrates the practice of the invention where the magnesium hydroxide is used rather than zinc oxide. Example IX illustrates the practice of the invention where aluminum sulfate is used rather than zinc oxide. The proportions of these alternative ingredients in each case are generally the same as the preferred proportions of zinc oxide.

The invention is especially advantageous in providing a no-rinse composition for inhibiting corrosion of ferrous or non-ferrous metal surfaced articles and in providing a receptive surface for synthetic resin coating compositions which is free from substances that would tend to increase or produce absorption of water or otherwise cause deterioration of the metal surface or of the synthetic resin coating applied thereto. At the same time the practice of the invention avoids rinsing after the application of the chromate depositing solution and thereby also avoids contamination of the environment and the cost of removing waste rinse waters. By the application of the invention the coating which is applied to the metal remains as such. Any excess coating which is removed by a squeegee or otherwise is re-used and does not become a waste product.

The invention is especially advantageous in treating ferrous or non-ferrous metal surfaced articles in the form of sheets, coils, wires, tubes or rods which are brought into contact with the chromate depositing solution at a linear speed of at least 50 feet per minute, the contact time preferably being 1–3 seconds so as to give a total coating weight within the range of 3 mg/square foot to 80 mg/square foot, or a coating weight of approximately 0.2 to 20 mg/square foot as Cr. When the resultant surface is dried or allowed to dry without rinsing and over-coated with a paint or synthetic coating composition, ferrous or non-ferrous metal surfaced articles are obtained which exhibit satisfactory resistance of the coating or film to impact, bending, boiling water, and creeping corrosion between the surface of the metal and the resinous film.

The invention is hereby claimed as follows:

1. A chromate depositing composition having a solids content within the range from 0.2 gram per liter to 75.0 grams per liter, the remainder being water, and consisting essentially of the following:

| Ingredients | Grams per Liter |
|---|---|
| Chromic acid ($CrO_3$), (expressed as Cr) | 0.10–50.0 |
| Hydrofluoric acid ($H_2F_2$) (expressed as F) | 0.01–5.0 |
| Fluoboric acid ($HBF_4$) (expressed as $BF_4$) | 0.01–50.0 |
| Sulfuric acid ($H_2SO_4$) (expressed as $SO_4$) | 0.01–5.0 |
| Hydrofluosilicic acid ($H_2SiF_6$) (expressed as $SiF_6$) | 0.0–5.0 |
| Additive from the group consisting of: zinc oxide, magnesium oxide, magnesium hydroxide, aluminum sulfate, aluminum hydroxide and mixtures thereof | 0.01–saturation solubility at 22° C. |

2. A chromate depositing composition as claimed in claim 1 in which the additive is zinc oxide.

3. A chromate depositing composition as claimed in claim 1 in which the additive is magnesium oxide.

4. A chromate depositing composition as claimed in claim 1 in which the additive is magnesium hydroxide.

5. A chromate depositing composition as claimed in claim 1 in which the additive is aluminum sulfate.

6. A chromate depositing composition as claimed in claim 1 in which the additive is zinc oxide and the amount corresponds to 1 to 6 grams per liter.

7. A chromate depositing composition as claimed in claim 1 in which the additive is zinc oxide and the weight ratio of chromic acid to zinc oxide is approximately 2:1.

8. A chromate depositing composition as claimed in claim 1 in which the ratio of the additive to the total acids is such as to give a pH within the range of 1.5 to 3.6 at 22° C. and a chromate concentration of 0.05 to 10.0 grams per liter, as Cr.

9. A process for treating ferrous or non-ferrous metal surfaced articles to improve corrosion resistance and receptivity to synthetic resin coatings which comprises bringing said surface into contact with a chromate depositing solution containing as essential components hexavalent chromium but no trivalent chromium, together with fluoboric acid, hydrofluoric acid, sulfuric acid with or without hydrofluosilicic acid, said solution also containing as an additive zinc oxide and/or magnesium oxide, and/or magnesium hydroxide, and/or aluminum sulfate, and/or aluminum hydroxide, the ratio of said additive to the total acids being such as to give a pH within the range of 1.5 to 3.6 at 22° C. and a chromate concentration of 0.05 to 10.0 grams per liter, as Cr, the remainder being water, and consisting essentially of the following:

| Ingredients | Grams per Liter |
|---|---|
| Chromic acid ($CrO_3$), (expressed as Cr) | 0.10–50.0 |
| Hydrofluoric acid ($H_2F_2$) (expressed as F) | 0.01–5.0 |

-continued

| Ingredients | Grams per Liter |
|---|---|
| Fluoboric acid ($HBF_4$) (expressed as $BF_4$) | 0.01–50.0 |
| Sulfuric acid ($H_2SO_4$) (expressed as $SO_4$) | 0.01–5.0 |
| Hydrofluosilicic acid ($H_2SiF_6$) (expressed as $SiF_6$) | 0.0–5.0 |
| Additive from the group consisting of: zinc oxide, magnesium oxide, magnesium hydroxide, aluminum sulfate, aluminum hydroxide and mixtures thereof | 0.01–saturation solubility at 22° C. |

10. A process for treating ferrous or non-ferrous metal surfaced articles as claimed in claim 9 in which the additive is zinc oxide.

11. A process for treating ferrous or non-ferrous metal surfaced articles as claimed in claim 9 in which the additive is magnesium oxide.

12. A process for treating ferrous or non-ferrous metal surfaced articles as claimed in claim 9 in which the additive is magnesium hydroxide.

13. A process for treating ferrous or non-ferrous metal surfaced articles as claimed in claim 9 in which the additive is aluminum sulfate.

14. A process as claimed in claim 9 in which the metal surfaced article is dried without rinsing and a coating composition which dries to a water resistant film is applied thereto.

15. A process as claimed in claim 14 in which the coating composition is an acrylic resin coating composition.

16. A process as claimed in claim 9 in which said ferrous and non-ferrous metals are from the group consisting of cold rolled steel, aluminized and galvanized iron and steel, aluminum, aluminum-zinc alloys, magnesium and magnesium-aluminum alloys.

17. A process as claimed in claim 9 in which said metal surfaced articles are in the form of sheets, coils, wires, tubes or rods which are brought into contact with said chromate depositing solution at a linear speed of at least 50 feet per minute, the said solution being effective to deposit at least 0.2 mg/square foot of chromate, as Cr.

18. A process as claimed in claim 9 in which the additive is zinc oxide and the weight ratio of chromic acid to zinc oxide is approximately 2:1.

19. A process as claimed in claim 9 in which the metal is aluminum and the ratio of the additive to the total acids is such as to give a pH within the range of 1.8 to 3.5 at 22° C.

20. A process as claimed in claim 9 in which the metal is galvanized iron or steel and the ratio of the additive to the total acids is such as to give a pH within the range of 1.8 to 3.5 at 22° C.

21. A process as claimed in claim 9 in which the metal is cold rolled steel and the ratio of the additive to the total acids is such as to give a pH within the range of 1.8 to 3.5 at 22° C. and the composition contains hydrofluosilicic acid.

22. A ferrous or non-ferrous metal surfaced article resulting from the process of claim 9.

23. An article as claimed in claim 22 overcoated with a coating composition which dries to a water resistant film.

* * * * *